US005199387A

United States Patent [19]

Ap

[11] Patent Number: 5,199,387

[45] Date of Patent: Apr. 6, 1993

[54] DUAL PHASE COOLING APPARATUS FOR AN INTERNAL COMBUSTION ENGINE

[75] Inventor: Srun N. Ap, Villepinte, France

[73] Assignee: Valeo Thermique Moteur, Le Mesnil-Saint-Denis, France

[21] Appl. No.: 852,643

[22] Filed: Mar. 17, 1992

[30] Foreign Application Priority Data

Mar. 20, 1991 [FR] France ..... 91 03410

[51] Int. Cl.[5] ..... F01P 9/02

[52] U.S. Cl. ..... 123/41.25; 165/110

[58] Field of Search ..... 123/41.2, 41.21, 41.22, 123/41.25, 41.44; 165/110, 114

[56] References Cited

U.S. PATENT DOCUMENTS

| | | | |
|---|---|---|---|
| 1,677,981 | 7/1928 | Muir | 123/41.21 |
| 2,281,091 | 4/1942 | Wallace | 123/41.25 |
| 2,458,609 | 1/1949 | Levesque du Rostu | 123/41.25 |
| 2,614,816 | 10/1952 | Hull | 165/111 |
| 3,096,818 | 7/1963 | Evans et al. | 165/111 |
| 3,223,075 | 12/1965 | Barlow | 123/41.24 |
| 3,989,103 | 11/1976 | Cieszko et al. | 165/110 |

*Primary Examiner*—Noah P. Kamen

*Attorney, Agent, or Firm*—Morgan & Finnegan

[57] ABSTRACT

In a dual phase cooling apparatus for an internal combustion engine, a condenser is interposed between a coolant fluid inlet, which receives coolant fluid as a mixture of its liquid and vapor phases from the engine, and a fluid outlet through which liquid coolant is returned to the engine. The condenser comprises a tube bundle mounted between two water boxes, at least one of which defines a phase separator interposed between the condenser fluid inlet and the condenser itself. One of the water boxes also carries a liquid reservoir interposed between the condenser itself and its fluid outlet. The structure may also include a pump for the liquid coolant fluid.

8 Claims, 3 Drawing Sheets

DUAL PHASE COOLING APPARATUS FOR AN INTERNAL COMBUSTION ENGINE

FIELD OF THE INVENTION

This invention relates to cooling apparatus for an internal combustion engine, in which the coolant fluid which undergoes ebullition in the engine leaves the latter as a mixture of its vapour and liquid phases, being afterwards condensed before returning to the engine in the liquid phase.

BACKGROUND OF THE INVENTION

A cooling apparatus of the above type operates in a socalled "dual phase" mode, in view of the fact that the coolant fluid, which is generally a mixture of water and antifreeze, is present in its two distinct phases, namely the liquid and vapour phases. Dual phase cooling must be distinguished from the conventional mode of cooling internal combustion engines in which the coolant fluid exists only in its liquid phase. In conventional cooling apparatus the coolant fluid in its liquid state is, after leaving the engine, cooled in a radiator which is equipped with a fan, after which it is passed back into the engine, flow of the liquid being obtained by forced convection under the action of a pump. In cooling apparatus operating in dual phase mode, the vapour is condensed in a condenser which is arranged in the same location as would be occupied by the cooling radiator in a conventional system.

Dual phase cooling systems for internal combustion engines are known per se. They include a coolant fluid inlet, into which the fluid is delivered in the form of a mixture of its vapour and liquid phases, a liquid coolant fluid outlet, a condenser interposed between the fluid inlet and the fluid outlet, a phase separator interposed between the fluid inlet and the condenser, a liquid reservoir or sump interposed between the condenser and the fluid outlet, and a liquid flow passage means connecting the phase separator and the liquid reservoir together. Such an apparatus will be referred to as a cooling apparatus of the kind specified.

It should be made clear that such dual phase cooling apparatuses are still in the experimental stage, and have not yet been fully developed for production. Production on an industrial basis is currently hindered by numerous practical difficulties. In particular, one of the disadvantages of such apparatuses lies in the fact that they call for a very large number of components, particularly a phase separator, a condenser, a liquid reservoir for acting as a sump, a circulating pump, and (where necessary) an expansion chamber.

Up to the present time, connecting all these various components together requires the use of a number of ducts or conduits of different diameters which have to be adapted as necessary to the flow of fluid in the vapour state or to flow of fluid in the liquid state, together with the appropriate connecting elements and pipe clips and the like. All this gives rise to a considerable danger of leakage of cooling fluid from the apparatus, both in the vapour and in the liquid state.

In addition, manufacture of such a cooling apparatus calls for complex assembly operations, and therefore makes them somewhat expensive, so that they are not at present a cost effective proposition for industrial production.

DISCUSSION OF THE INVENTION

A main object of the invention is to overcome the above mentioned drawbacks.

To this end, the invention is concerned with a cooling apparatus of the kind specified, in which the condenser comprises a bundle of heat exchange tubes carrying at least one water box or manifold (or header), and in which the phase separator and liquid reservoir are carried by at least one said water box. This gives a cooling apparatus having a complex structure in which the phase separator and liquid reservoir or sump are an integral part of the condenser itself, being carried by at least one water box of the latter. In this way it is possible to group within a single unit the condenser (defined by its tube bundle and water boxes), the phase separator, the liquid reservoir, and any other components that may be provided as necessary as part of the cooling apparatus.

Such an apparatus not only offers improved compactness as compared with the known dual phase cooling apparatuses, but also enables direct communication to be obtained between the various components, thus eliminating, or drastically reducing the number of, the various connecting ducts, pipes or tubes, tube connectors, and pipe clips. Accordingly, the danger of leakage and the cost of assembly are both substantially reduced.

In a first form of apparatus according to the invention, the tube bundle of the condenser is arranged for generally horizontal flow of the fluid therein, being mounted between two water boxes one of which carries both the phase separator and the liquid reservoir, while the other fluid box brings two parts of the tube bundle into communication with each other. This type of embodiment is of particular advantage given that the phase separator and liquid reservoir are grouped together in a single water box of the condenser.

Preferably, the said water box is mounted generally vertically, and includes an upper part which defines the phase separator and carries the fluid inlet to the condenser, together with a lower part which defines the liquid reservoir and carries the fluid outlet from the condenser, with the said liquid flow passage means consisting of a passage which connects the upper and lower parts of the water box directly together.

The upper part of the water box preferably comprises a first compartment for retaining the liquid separated by the phase separator, with this first compartment being open at its base into the liquid flow passage means, together with a second compartment which communicates with the first compartment and also with part of the tube bundle of the condenser for introducing the separated vapour into the latter, while the lower part of the fluid box comprises a compartment defining the liquid reservoir and arranged to receive coolant fluid from another part of the tube bundle of the condenser.

It will be realised that, in consequence, the flow of the cooling fluid in the tube bundle follows a U-shaped path.

According to a preferred feature of the invention, the lower part of the fluid box includes a circulating pump for pumping the liquid from the reservoir towards the fluid outlet of the condenser.

In a second form of cooling apparatus in accordance with the invention, the tube bundle of the condenser is arranged for generally vertical flow of the coolant fluid therein, being mounted between two water boxes, with one of the water boxes being arranged at the top of the tube bundle and defining the separator and carrying the fluid inlet to the condenser, while the other water box is arranged at the lower end of the tube bundle and defines the liquid reservoir and carries the fluid outlet of the condenser, the liquid flow passage means being defined by a pipe or tube which connects the phase separator and liquid reservoir together.

In this second form of the invention, the phase separator is part of one of the water boxes, while the liquid reservoir is part of the other.

The phase separator preferably comprises a liquid collecting compartment which is an extension of the water box and which is provided with a pipe connector for connection of one end of the liquid flow passage means (or pipe), while the liquid reservoir is an extension of the lower water box and carries a similar connection for connection of the other end of the liquid flow pipe.

The lower water box preferably includes a circulating pump for pumping the liquid from the reservoir towards the fluid outlet of the condenser.

In either of the two forms mentioned above, the apparatus preferably also includes a sealed expansion chamber connected to the water box that defines the phase separator.

According to a further preferred feature of the invention, the condenser also includes a fan, and the apparatus is provided with temperature or pressure sensors for controlling the operation of the fan according to the prevailing conditions.

Preferred embodiments of the invention will be described below, by way of example only and with reference to the accompanying drawings.

DESCRIPTION OF PREFERRED EMBODIMENTS OF THE INVENTION

Figure 1:
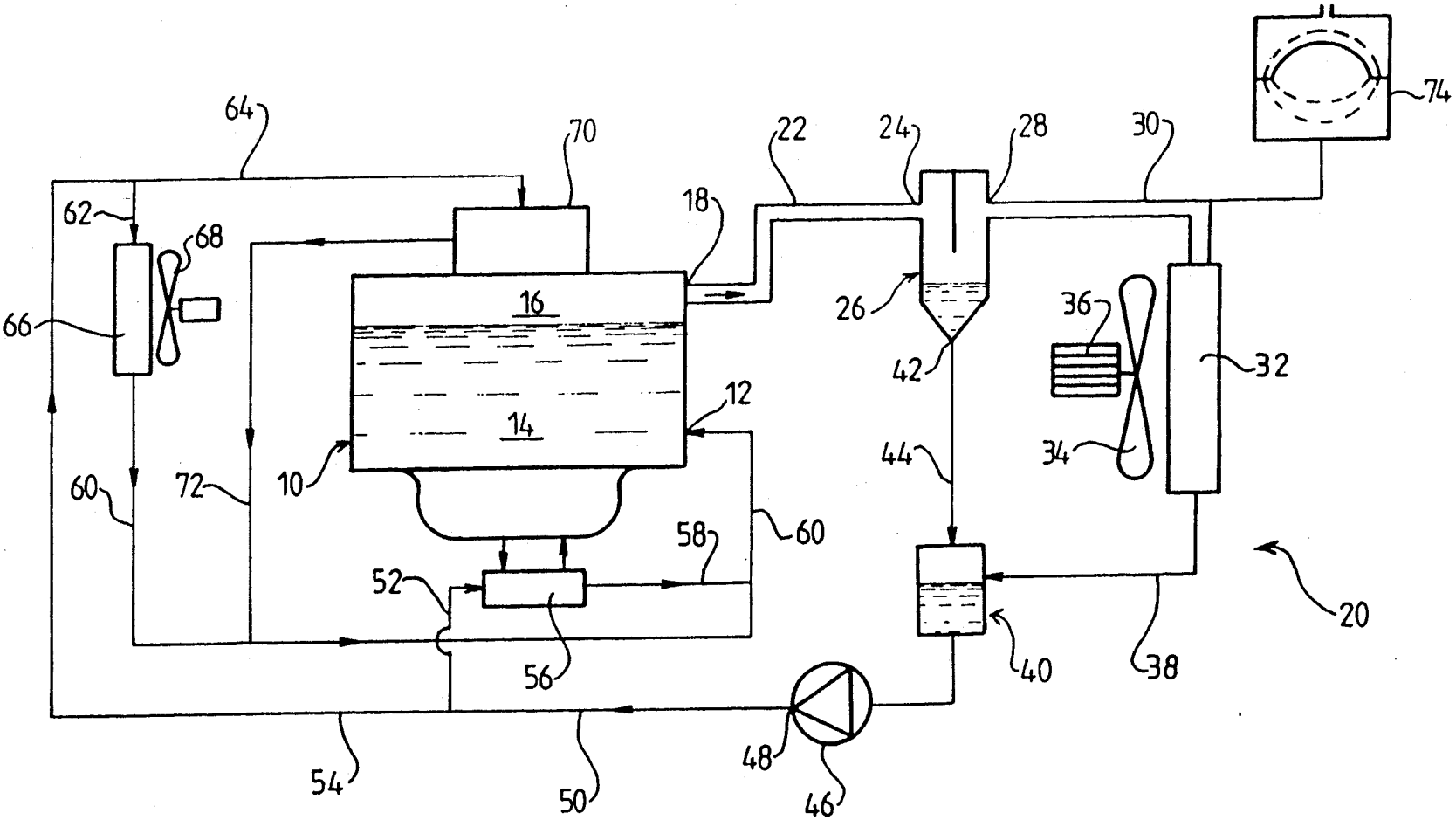
FIG. 1 is a flow circuit diagram illustrating the operation of a cooling apparatus working in a dual phase mode, for an internal combustion engine in accordance with the prior art.

Reference is first made to FIG. 1, which shows an internal combustion engine 10, which is cooled by a coolant fluid, for example a mixture of water and antifreeze, which enters through an inlet 12 of the engine to constitute a mass 14 of fluid in the liquid phase. This coolant fluid is brought by ebullition, generally at a temperature lying in the range between 100° and 120° C. into contact with the engine so as to create a mass of fluid 16 in the vapour phase. The cooling fluid in the vapour phase and in the liquid phase leaves the engine 10 through an outlet 18, to be led to a cooling apparatus operating in the dual phase mode and generally indicated at 20.

The coolant fluid leaves the engine through a duct 22 which brings it to the inlet 24 of a phase separator 26, otherwise known as a liquid/vapour separator, which separates the two phases of the coolant from each other. The vapour phase leaves the separator 26 through a vapour outlet 28, and is led through a further duct 30 to a condenser 32. A fan 34, driven by an electric motor 36, is associated with the condenser 32. An expansion chamber 74, for absorbing variations in the dilatation of the coolant fluid, is connected on the duct 30 which connects the separator 26 to the condenser 32.

In the condenser 32, the coolant fluid in its vapour phase is condensed so as to form a liquid phase which is then directed through a further duct 38 to a liquid reservoir 40, otherwise referred to as a sump.

The liquid phase after being separated out by the separator 26, leaves the latter through a liquid outlet 42, from where it is led towards the reservoir 40 through a suitable duct 44. The fluid in its liquid phase is then removed from the reservoir 40 by a circulating pump 46, the outlet 48 of which is connected into a feed duct 50, which is divided downstream of the pump into two branches 52 and 54. The branch 52 returns the fluid in its liquid state directly to the coolant inlet 12 of the engine, via a supplementary heat exchanger, for example an oil cooler 56, and via a duct 58 leading into an engine feed duct 60 which terminates at the coolant inlet 12. The other branch, 54, is further divided, downstream of its junction with the branch 52, into two further branches 62 and 64. The branch 62 supplies a heat exchanger 66, which is a heating radiator for the cabin of the vehicle. A motorised fan unit 68 is associated with this heating radiator 66. The coolant fluid leaves the cabin heating radiator 66 via the outlet of the latter and the engine feed duct 60, which passes it to the coolant inlet 12 of the engine.

The branch 64 also returns some of the coolant fluid to the engine coolant inlet 12 through yet another heat exchanger, such as an engine air preheater 70, the outlet of which is connected through a duct 72 which leads into the engine feed duct 60.

In the system shown in FIG. 1, the coolant fluid enters the engine in its liquid phase, where it undergoes ebullition to form the vapour phase. The mixture of the liquid and vapour phases then leaves the engine for subsequent cooling and condensation in the condenser 32, which takes the place of the cooling radiator conventionally found in an engine cooling apparatus.

It will be understood that in practice the cooling apparatus 20 shown in FIG. 1 requires the use of a number of different types of ducts, as well as a large number of fluid connections and pipe clips, and this leads to the various disadvantages discussed above. The avoidance of these drawbacks, and the achievement of a structure which is particularly compact, in an apparatus according to the invention will be apparent from the remainder of this description relating to FIGS. 2 to 5.

Figure 3:
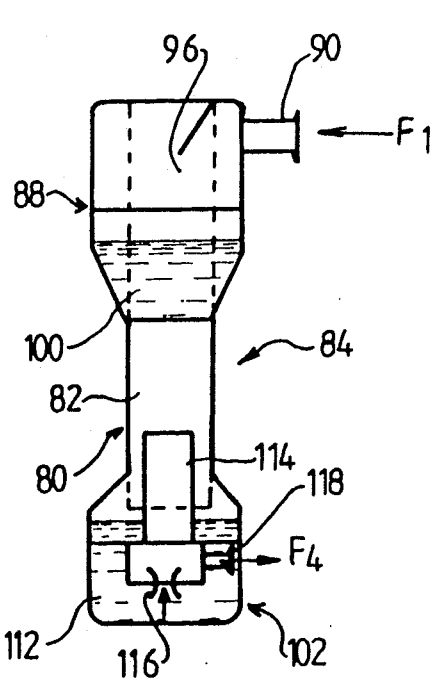
FIG. 3 is a side view of the same cooling apparatus.
Figure 2:
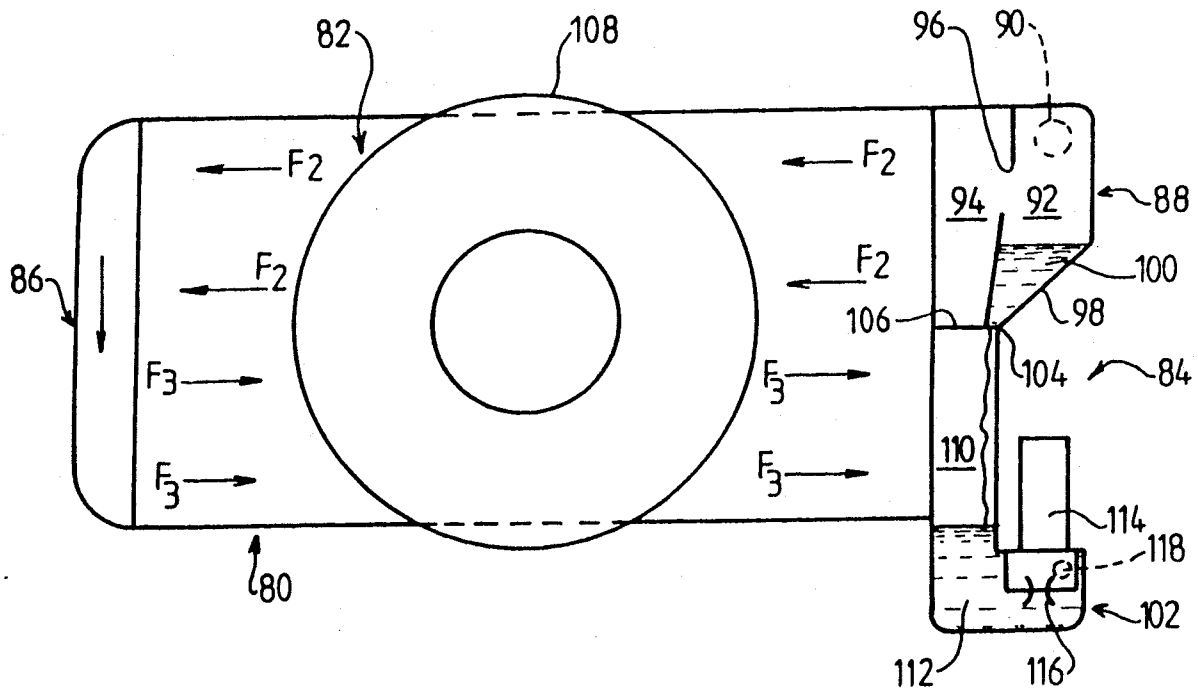
FIG. 2 is a view in elevation showing a cooling apparatus in a first embodiment of the present invention.

Reference is now made to FIGS. 2 and 3 in which the cooling apparatus comprises a condenser 80 which enables the coolant fluid to flow in a generally horizontal direction. The condenser 80 includes a bundle 82 consisting of a group of tubes (not shown) which are arranged horizontally, with one end of the tube bundle being connected into a first water box or manifold 84, and its other end into a second water box or manifold 86. The first water box 84 is arranged generally vertically, and comprises an upper part 88 having an inlet 90 for introduction of the coolant fluid in the liquid and vapour phases, received from the engine in the direction of the arrow F1 in FIG. 3. The upper part 88 of the water box 84 acts as a phase separator, and for this purpose it comprises a first compartment 92 into which the inlet 90 is open, and a second compartment 94 adjacent to the compartment 92 and communicating with the latter through a flow orifice 96 which is defined at approximately midheight of the two compartments 92 and 94. At its base, the first compartment 92 defines a receptacle 98 for holding the fluid 100 in its liquid phase, the latter being subsequently led into the lower part 102 of the water box 84 via a flow passage 104 which leads out of the base of the receptacle 98.

The second compartment 94 is delimited at the bottom by a bulkhead 106. The compartment 94 collects the fluid in its vapour phase, and enables the latter to be led in to part of the tube bundle 82 in the direction of the arrows F2 in FIG. 2. As it passes through the tube bundle, the vapour is condensed to the liquid phase under the action of the cooling air passing through the heat exchanger. The flow of this air may be accelerated by means of a motorised fan unit indicated diagrammatically at 108 in FIG. 2. After passing through the tube bundle, the fluid reaches the second water box 86, from which it then passes through the other part of the tube bundle 82 in the direction of the arrows F3, so as eventually to reach the lower part 102 of the first water box 84. The lower part 102 comprises a compartment 110 into which the second or lower part of the tube bundle 82 is open. The compartment 102 is extended downwardly via a sump 112 which collects both the fluid in its liquid phase delivered via the flow passage 104, and that which reaches the compartment 110 via the lower part of the tube bundle 82.

The lower part 102 also includes an electric pump 114, having an inlet 116 which communicates with the sump or reservoir 112 and with an outlet branch tube 118 through which the coolant fluid (in the liquid phase) is led to the engine as indicated by the arrow F4 in FIG. 3.

In the embodiment shown in FIGS. 2 and 3, the first water box 84 thus constitutes a compact module which includes the main components of the cooling apparatus, namely the liquid vapour separator, the liquid sump, and the circulating pump. This module may also include a sealed expansion chamber similar to the chamber 74 in FIG. 1, but not shown in FIGS. 2 and 3. In addition, the first water box 84 may act as a support for various other components for controlling the operation of the apparatus, in particular temperature or pressure sensors (not shown) for controlling the operation of the motorised fan unit 108 if the latter is provided.

Figure 5:
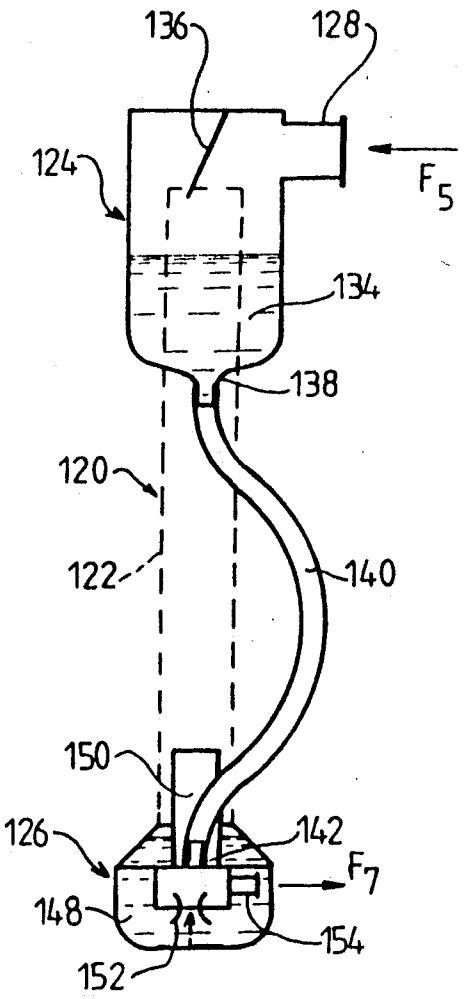
FIG. 5 is a side view of the cooling apparatus seen in FIG. 4.
Figure 4:
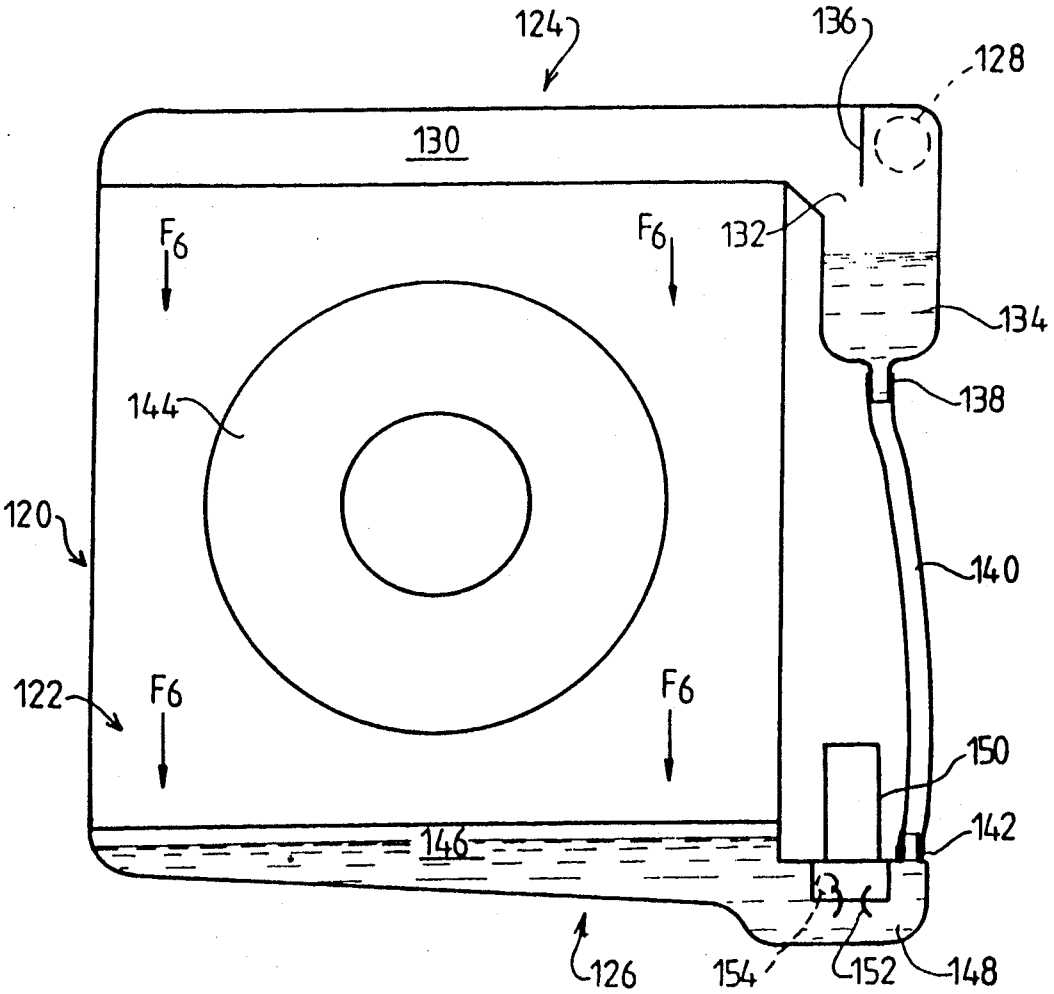
FIG. 4 is a view in elevation showing the cooling apparatus in a second embodiment of the present invention.

Reference is now made to FIGS. 4 and 5 showing a modified embodiment of the apparatus. This comprises a condenser 120, which includes a tube bundle 122 so oriented that the coolant fluid flows in a generally vertical direction through it. The tube bundle 122 comprises a group of tubes (not shown individually), arranged generally vertically and open firstly into an upper water box 124 and secondly into a lower water box 126. The upper water box 124 has an inlet 128 for the coolant fluid in the form of a mixture of the vapour and liquid phases coming from the motor in the direction of the arrow F5 in FIG. 5. The water box 124 includes an upper header compartment 130 which extends over the whole width of the tube bundle 122, and which communicates through an orifice 132 with a compartment 134 for collecting the coolant fluid in liquid form. The water box 124 is partly divided by a bulkhead 136 which is arranged close to the fluid inlet 128 so as to force the fluid entering the water box from the latter to pass downwardly. The lower part of the liquid collecting compartment 134 has an outlet 138 connected to a liquid flow pipe 140, the other end of which is connected to an inlet 142 of the lower water box 126.

The coolant fluid, in the form of a mixture of its liquid and vapour phases, enters the water box 124 and is then separated into its two phases. The liquid phase is collected in the compartment 134, while the vapour phase passes into the upper header compartment 130, from where it passes through the tube bundle 122 over the whole width of the latter, as indicated by the arrows F6 in FIG. 4. During its passage through the heat exchanger, the coolant fluid vapour is condensed to liquid form by heat exchange with the cool air passing through the tube bundle 122. Again, the flow of this cooling air may be accelerated by means of a motorised fan unit 144.

The liquid coolant fluid is then collected in the lower water box 126. This latter comprises a lower header compartment 146 which again extends over the whole width of the tube bundle 122, and in which the liquid coolant fluid received from the tube bundle 122 is collected. The water box 126 is extended laterally by a liquid reservoir or sump 148 which is arranged vertically below the liquid collecting compartment 134 of the upper water box 124. The sump 148 carries the inlet 142 in its upper part. Thus, the sump or reservoir 148, lying at a generally lower level than the lower header compartment 146, collects both the liquid received from the latter and the liquid received from the collecting compartment 134 via the liquid flow pipe 140. The sump 148 is provided with an electric pump 150 having an inlet 152 which is open into the sump 148. The coolant fluid is pumped by this pump, via the outlet 154 of the latter, to the engine as indicated by the arrow F7 in FIG. 5.

The upper water box 124 may also carry an expansion chamber (not shown) similar to the expansion chamber 74 in FIG. 1. In addition, the upper water box 124, and/or the lower water box 126, may carry various control elements such as pressure or temperature sensors (not shown) for controlling the motorised fan unit 144 if the latter is provided.

The apparatus as shown in FIGS. 4 and 5 operates in exactly the same way as that shown in FIGS. 2 and 3. The choice as to which embodiment is used will depend largely on design considerations in connection with the accommodation of the apparatus in a particular motor vehicle.

What is claimed is:

1. A cooling apparatus for an internal combustion engine, comprising means defining a coolant fluid inlet for a coolant fluid in the form of a mixture of its vapour and liquid phases, means defining a coolant fluid outlet for the coolant fluid in its liquid phase, a condenser interposed between said inlet and outlet, a phase separator interposed between said inlet and condenser, a liquid reservoir interposed between the condenser and said outlet wherein the condenser comprises a heat exchange tube bundle disposed for generally horizontal flow of fluid therein between the phase separator and said liquid reservoir and an integral water box carried by said tube bundle, said water box comprising an upper part which defines the phase separator and said fluid inlet, together with a lower part which defines said liquid reservoir and fluid outlet, the apparatus further including liquid flow passage means for directly communicating all of the coolant liquid from the upper part of said water box to the liquid reservoir in the lower part of said water box.

2. Apparatus according to claim 1, wherein the upper part of said water box defines a first compartment for holding the liquid separated from the mixture received via said fluid inlet, said first compartment being open at its base into said liquid flow passage means, together with a second compartment communicating with the first compartment and with part of the tube bundle of the condenser for introduction of the vapour separated in the phase separator into said part of the tube bundle, with the lower part of the water box communicating with a further part of the tube bundle of the condenser and with the liquid flow passage means.

3. A cooling apparatus for an internal combustion engine, comprising means defining a coolant fluid inlet for a coolant fluid in the form of a mixture of its vapour and liquid phases, means defining a coolant fluid outlet for the coolant fluid in its liquid phase, a condenser interposed between said inlet and outlet, a phase separator, interposed between said inlet and condenser, a liquid reservoir interposed between the condenser and said outlet, wherein the condenser comprises a heat exchange tube bundle disposed for generally horizontal flow of fluid therein between the phase separator and said liquid reservoir and at least one water box carried by said tube bundle, said water box comprising an upper part which defines the phase separator and said fluid inlet, together with a lower part which defines said liquid reservoir and fluid outlet, the apparatus further including liquid flow passage means connecting said upper and lower parts of said water box directly together, the upper part of said water box defining a first compartment for holding the liquid separated from the mixture received via said fluid inlet, said first compartment being open at its base into said liquid flow passage means, together with a second compartment communicating with the first compartment and with a first part of the tube bundle of the condenser for introduction of the vapour separated in the phase separator into said first part of the tube bundle, with the lower part of the water box communicating with a second part of the tube bundle of the condenser and with the liquid flow passage means for receiving liquid from said liquid flow passage means; and a pump disposed in said lower part of the water box for circulating liquid from the liquid reservoir to the fluid outlet.

4. A cooling apparatus for an internal combustion engine, comprising means defining a coolant fluid inlet for a coolant fluid in the form of a mixture of its vapour and liquid phases, means defining a coolant fluid outlet for the coolant fluid in its liquid phase, a condenser interposed between said inlet and outlet, a phase separator interposed between said inlet and condenser, a liquid reservoir interposed between the condenser and said outlet, wherein the condenser comprises a bundle of heat exchange tubes disposed generally vertically for generally vertical flow of the fluid therein between the phase separator and said liquid reservoir, an upper water box connected to the upper end of the tube bundle, and a lower water box connected to the lower end of the tube bundle, the upper water box defining the phase separator and including said fluid inlet, the lower water box defining said liquid reservoir and having said fluid outlet, the apparatus further comprising liquid flow passage means comprising a pipe joining the phase separator with the liquid reservoir for directly communicating all of the coolant liquid from the phase separator to said lower water box, and means for facilitating the flow of all the liquid coolant from the phase separator to the lower water box.

5. Apparatus according to claim 4, wherein the upper water box defines a liquid collecting compartment extending along the width of the tube bundle an outlet connection carried by said liquid collecting compartment and connected to one end of said liquid flow passage means, the lower water box extending along the width of the tube bundle and including a pipe connection to which the other end of the liquid flow passage means is connected.

6. A cooling apparatus for an internal combustion engine, comprising means defining a coolant fluid inlet for a coolant fluid in the form of a mixture of its vapor and liquid phases, means defining a coolant fluid outlet for the coolant fluid in its liquid phase, a condenser interposed between said inlet and outlet, a phase separator interposed between said inlet and condenser, a liquid reservoir interposed between the condenser and said outlet, wherein the condenser comprises a bundle of heat exchange tubes disposed generally vertically for generally vertical flow of the fluid therein between the phase separator and liquid reservoir, an upper water box connected to the upper end of the tube bundle, and a lower water box connected to the lower end of the tube bundle, the upper water box defining the phase separator and including said fluid inlet, the lower water box defining said liquid reservoir and having said fluid outlet, the apparatus further comprising liquid flow passage means comprising a pipe joining the phase separator with the liquid reservoir, said upper water box defining a liquid collecting compartment extending the width of the tube bundle, said cooling apparatus further comprising an outlet connection carried by said liquid collecting compartment and connected to one end of said liquid flow passage means, said lower water box extending the width of said tube bundle and including a pipe connection to which the other end of the liquid flow passage means is connected, and a pump disposed in the lower water box for directing fluid from said liquid reservoir to said fluid outlet.

7. A compact cooling apparatus for an internal combustion engine comprising:

an integral water box having first and second chambers, said first chamber including a coolant fluid inlet for a coolant fluid mixture comprising the fluid's vapor and liquid phases; a first compartment for collecting the liquid phase of said mixture; means for facilitating a flow of all the coolant liquid out of said first compartment; and a second compartment for collecting the vapor phase of said mixture;

a condenser member having a plurality of tubular members, a first group of tubular duct members communicating with said second compartment of said first water box chamber;

said second chamber being in communication with a second group of tubular duct members such that vapor from the second compartment of said first water box chamber is communicated to said condenser, converted to liquid and communicated to said second water box chamber, said second chamber further including a liquid fluid outlet;

a liquid flow member having one end communicating with the first compartment of said first water box chamber and another end communicating with said second water box chamber for directly communicating all the liquid from the first compartment of said first water box chamber to the second water box chamber;

a pump disposed in said water box second chamber for communicating to said engine the liquid received from said condenser and directly from said water box first chamber;

flow means disposed between said outlet and the engine; and flow means disposed between the engine and said inlet.

8. The cooling apparatus of claim 7 wherein said first compartment in said first water box chamber tapers in cross-section towards said liquid flow member to facilitate flow of all the liquid collected in said water box first chamber to said second water box chamber.

* * * * *